US006250651B1

(12) United States Patent
Reuss et al.

(10) Patent No.: US 6,250,651 B1
(45) Date of Patent: Jun. 26, 2001

(54) ADJUSTABLE STRAP

(75) Inventors: Stefan Reuss, Burlington; Ryan Coulter, Stowe; Brian D. West, Burlington, all of VT (US); Christopher M. Doyle, Santa Fe, NM (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/205,761

(22) Filed: Dec. 4, 1998

(51) Int. Cl.[7] ..... A63C 5/00

(52) U.S. Cl. ..... 280/14.21; 24/705 K

(58) Field of Search ..... 280/14.21, 14.22, 280/809; 36/50.5, 117.1; 24/68 RT, 69 RT, 705 K, 713 K, 695 K

(56) References Cited

U.S. PATENT DOCUMENTS

| | | | |
|---|---|---|---|
| 478,120 | 7/1892 | Mead . | |
| 986,988 | 3/1911 | Johnson . | |
| 2,459,348 | 1/1949 | Webb et al. . | |
| 3,545,103 | 12/1970 | Bloomfield et al. . | |
| 3,975,838 | 8/1976 | Martin . | |
| 4,112,557 | 9/1978 | Salomon . | |
| 4,193,171 | 3/1980 | Lichowsky . | |
| 4,326,320 | 4/1982 | Riedel . | |
| 4,395,801 | 8/1983 | Gabrielli . | |
| 4,453,290 | 6/1984 | Riedel . | |
| 4,547,980 | 10/1985 | Olivieri . | |
| 4,553,292 | 11/1985 | Pradier et al. . | |
| 4,596,080 | 6/1986 | Benoit et al. . | |
| 4,669,201 | 6/1987 | Pozzobon . | |
| 4,670,946 | 6/1987 | Olivieri . | |
| 4,683,620 | 8/1987 | Valsecchi et al. . | |
| 4,761,898 | 8/1988 | Courvoisier et al. . | |
| 4,796,337 | 1/1989 | Marxer . | |
| 5,172,454 | 12/1992 | Martignago . | |
| 5,195,259 | 3/1993 | Lucchetta et al. . | |
| 5,261,689 | 11/1993 | Carpenter et al. . | |
| 5,356,170 | 10/1994 | Carpenter et al. . | |
| 5,379,532 | 1/1995 | Seidel . | |
| 5,485,688 | 1/1996 | Gorza et al. . | |
| 5,570,522 | 11/1996 | Olsen et al. | 36/50.5 |
| 5,630,253 | 5/1997 | Benoit et al. . | |
| 5,745,959 | 5/1998 | Dodge . | |
| 5,745,963 | 5/1998 | Graziano . | |
| 5,758,895 | 6/1998 | Bumgarner . | |
| 5,779,259 | 7/1998 | Lin . | |
| 6,056,300 | 5/2000 | Carpenter et al. | 280/14.2 |

FOREIGN PATENT DOCUMENTS

| | | | |
|---|---|---|---|
| 272166 | 7/1927 | (DE) . | |
| 2712737A1 | 9/1978 | (DE) . | |
| 3838474A1 | 5/1990 | (DE) . | |
| 787512 | 8/1997 | (DE) . | |
| 0 242 531 | 10/1987 | (EP) . | |
| 0 242 549 | 10/1987 | (EP) . | |
| 0 793 983 A1 | 9/1997 | (EP) | A63C/9/08 |
| 0 824 942 A1 | 2/1998 | (EP) | A63C/9/08 |

*Primary Examiner*—Richard M. Camby
(74) *Attorney, Agent, or Firm*—Wolf, Greenfield & Sacks, P.C.

(57) ABSTRACT

An adjustable strap that limits separation of the strap portions from each other. The strap provides for quick and easy one hand operation by allowing a user to fully loosen and tighten the strap without the need for rejoining the strap portions to each other. The strap may also maintain the overlapping sections of the strap portions in close proximity and generally parallel to each other, such as when bending and/or adjusting the strap across a curved surface, to substantially reduce the likelihood of a loose strap end. The adjustable strap may include an engagement strap with a fastening device, such as a ratchet buckle, mounted to one end thereof, and a ratchet strap that passes through the ratchet buckle to be adjusted relative to the engagement strap for a desired tightness. The engagement strap may include a stop that coacts with the ratchet strap to limit relative movement between the engagement and ratchet straps. An elongated slot may be disposed along the engagement strap to guide and limit travel of an anchor to which is fastened the tip of the ratchet strap.

45 Claims, 5 Drawing Sheets

ADJUSTABLE STRAP

BACKGROUND OF THE INVENTION

1. Field of the Invention

The present invention relates generally to an adjustable strap and, more particularly, to an adjustable strap for a binding or a boot.

2. Description of Related Art

Adjustable straps are commonly found in sports shoes or boots, such as in-line skates, ski boots, snowboard boots and the like, and in bindings for sport shoes or boots, such as snowboard and ski bindings. An adjustable strap typically includes a pair of strap portions that are adjustably secured to each other using a buckle, such as a ratchet buckle, that permits incremental tightening of the binding straps as well as quick release of the buckle and straps.

In many applications, the strap portions are separated from each other to completely loosen the strap. For example, a strap binding system for soft snowboard boots typically includes one or more straps for securing the boot to the snowboard. The strap portions are separated from each other to provide an opening for the rider to place his or her foot into the binding. The strap portions are then rejoined and tightened around the seated boot to securely hold the boot on the snowboard.

A day of riding may involve numerous occurrences of releasing and securing the binding strap because the user must remove the rear boot from its binding prior to ascending the mountain on the chair lift and then, upon exiting the chair lift, must reattach the rear boot and binding prior to the next ride down the trail. Securing the straps requires the user to rejoin the strap portions by inserting one of the strap portions through the buckle using both hands in the process. The ease in which a binding strap may be released and then secured is important in snowboarding.

It is an object of the present invention to provide an improved adjustable strap that limits separation of the strap portions from each other for quick and easy tightening and loosening of the strap.

SUMMARY OF THE INVENTION

One embodiment of the invention is directed to an adjustable strap comprising a first strap including a fastening device mounted at one end thereof and a second strap extending through the fastening device to adjustably attach the second strap to the first strap. The fastening device has a locking mode and a release mode. A stop is provided to limit withdrawal of the second strap through the fastening device when the fastening device is in the release mode to otherwise permit withdrawal of the second strap therethrough.

Another embodiment of the invention is directed to an adjustable strap comprising a first strap including a buckle mounted to the first strap at a first location thereon, and a second strap that is slidably received through the buckle to be adjustably secured to the first strap at the first location. The second strap is also slidably attached to the first strap at a second location that is spaced from the first location. A portion of the first and second straps overlap each other between the first and second locations, and the second strap is maintained substantially parallel to the first strap between the first and second locations.

A further embodiment of the invention is directed to a snowboard binding comprising a base plate that is mountable to a snowboard and is adapted to receive a boot, and an adjustable strap mounted to the base plate to extend across a portion thereof to secure the boot to the snowboard. The adjustable strap comprises a first strap including a buckle mounted at a first end thereof, and a second strap including an end portion extending through the fastening device to adjustably attach the second strap to the first strap. The buckle has a locking mode and a release mode. An anchor is slidably supported by the first strap with the end portion of the second strap being attached to the anchor to maintain the end portion in close proximity to the first strap and to limit withdrawal of the second strap through the buckle when the buckle is in the release mode to otherwise permit withdrawal of the second strap therethrough.

Other objects and features of the present invention will become apparent from the following detailed description when taken in connection with the accompanying drawings. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION

The present invention is directed to an adjustable strap that limits separation of the strap portions from each other. The strap provides for quick and easy one hand operation by allowing a user to fully loosen and tighten the strap without the need for rejoining the strap portions to each other. The strap may also maintain the overlapping sections of the strap portions in close proximity and generally parallel to each other, such as when bending and/or adjusting the strap across a curved surface, to substantially reduce the likelihood of a loose strap end. The adjustable strap is particularly suited for use with a snowboard binding and/or boot, although the present invention is not limited to such an implementation.

Figure 1:
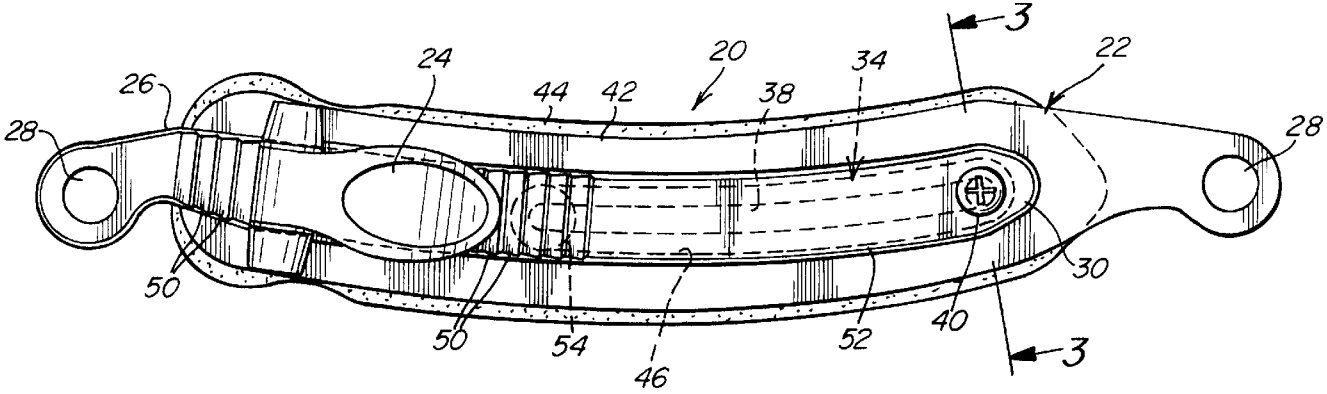
FIG. 1 is a top plan view of an adjustable strap in accordance with one illustrative embodiment of the present invention in a fully shortened position.
Figure 2:
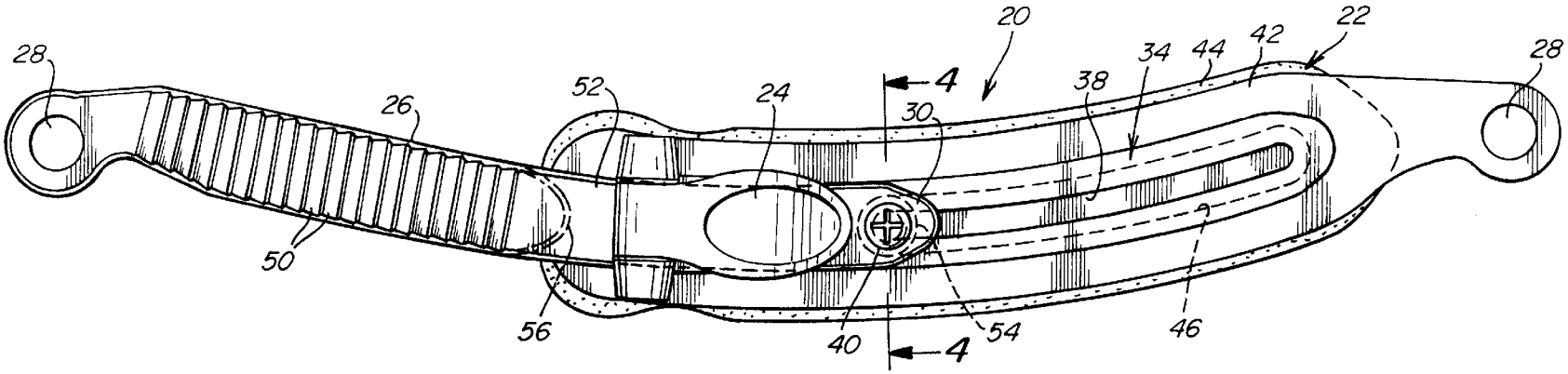
FIG. 2 is a top plan view of the adjustable strap of FIG. 1 in a fully extended position.
Figure 3:
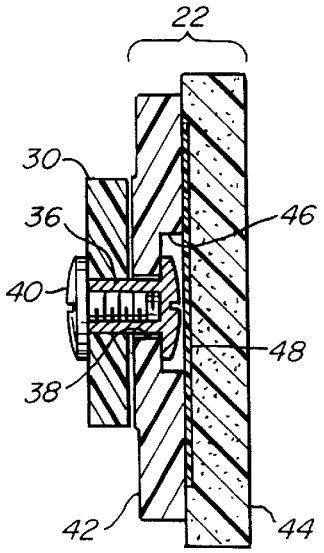
FIG. 3 is a cross sectional view taken along section line 3—3 of FIG. 1.

In one illustrative embodiment of the invention as shown in FIGS. 1–6, the adjustable strap 20 includes an engagement strap portion 22 with a fastening device, such as a ratchet buckle 24, mounted to one end thereof, and a ratchet strap portion 26 that passes through the ratchet buckle 24 to be adjusted relative to the engagement strap 22 for a desired tightness. Opposite ends of the strap portions may be configured to be mounted to an article, such as a binding and a sport shoe or boot. As illustrated in FIGS. 1–2, opposite ends of the strap portions may be provided with apertures 28 that are adapted to receive a bushing and/or any suitable fastener, such as a screw, rivet or the like, therethrough to mount the adjustable strap 20 to the article. The ratchet strap 26 may include a rounded or tapered tip 30 that is easily inserted through the buckle 24.

The adjustable strap may be incrementally adjusted to various lengths between a fully shortened position (FIG. 1) and a fully extended position (FIG. 2) to provide a range of strap adjustability. To establish the range of strap adjustability, the engagement strap 22 may include a stop that coacts with the ratchet strap 26 to limit relative movement between the engagement and ratchet straps. As shown in FIG. 2, the stop may be configured to prevent withdrawal of the tip 30 of the ratchet strap 26 through the buckle 24 so that the strap may be readily tightened without having to align and reinsert the ratchet strap 26 through the buckle 24.

In one illustrative embodiment, the stop includes an elongated track 34 on the engagement strap 22 and an anchor 36 that rides along the track. The tip portion 30 of the ratchet strap is secured to the anchor 36 so that movement of the ratchet strap 26 relative to the engagement strap 22 is limited to the length of the track. It is to be understood that the anchor may be secured to any portion of the ratchet strap and the track may have any desired length to limit the range of adjustability of the ratchet strap relative to the engagement strap.

As illustrated, the track 34 may include an elongated slot 38 disposed along a portion of the engagement strap 22 to guide and limit travel of the anchor 36 along the strap. In one embodiment, the anchor 36 extends through and slides along the length of the slot 38. A fastener 40, such as a screw or the like, may be used to secure the ratchet strap 26 to the anchor 36, such as a T-nut. It is to be appreciated, however, that other stop configurations may be implemented on the engagement strap to limit the adjustability of the straps, and the present invention is not limited to the particular arrangement shown.

In one illustrative embodiment, the engagement strap 22 includes a strap body 42 and a pad 44 supported on the strap body to cushion and distribute pressure applied by the strap. As shown in FIGS. 3–6, the slot 38 extends through the strap body 42 into an enlarged inner channel 46 disposed on the inner surface of the strap body. The channel 46 is positioned adjacent the pad 44 to receive the anchor 36 therein so that the anchor slides freely along the slot 38 in spaced relation to the pad. An intermediate layer 48 or sheet of material may be disposed between the strap body 42 and the pad 44 to overlie the inner channel 46 and provide a low friction interface between the anchor 36 and the pad 44. The pad 44 and intermediate layer 48 may be attached to the strap body using an adhesive, stitching or a combination thereof. It is to be understood that other configurations may be implemented for the engagement strap. For example, the engagement strap may include an elongated tunnel (not shown) for covering the track and slidably receiving the end portion of the ratchet strap therein.

The ratchet strap 26 may include a plurality of teeth 50 or serrations disposed on at least a portion of its upper surface that coact with the ratchet buckle 24 to drive the ratchet strap through the buckle to selectively tighten the strap 20. In one illustrative embodiment, a substantial length of the ratchet strap is free of teeth to provide a smooth extension 52 that may be easily slid through the buckle 24 (FIG. 6) without buckle actuation. The smooth extension 52 facilitates one hand operation of the adjustable strap by allowing quick and easy release and closure of the ratchet strap relative to the engagement strap. As illustrated, the smooth extension 52 has a length that is greater than the length of the buckle 24 and may extend from approximately the midpoint of the ratchet strap 26 to its tapered tip 30. It is to be appreciated, however, that the smooth extension 52 can be any length required for a particular application. For example, the entire ratchet strap 26 may be smooth and free of teeth 50 or serrations. Alternatively, the ratchet strap 26 may be provided without a smooth extension.

Figure 5:
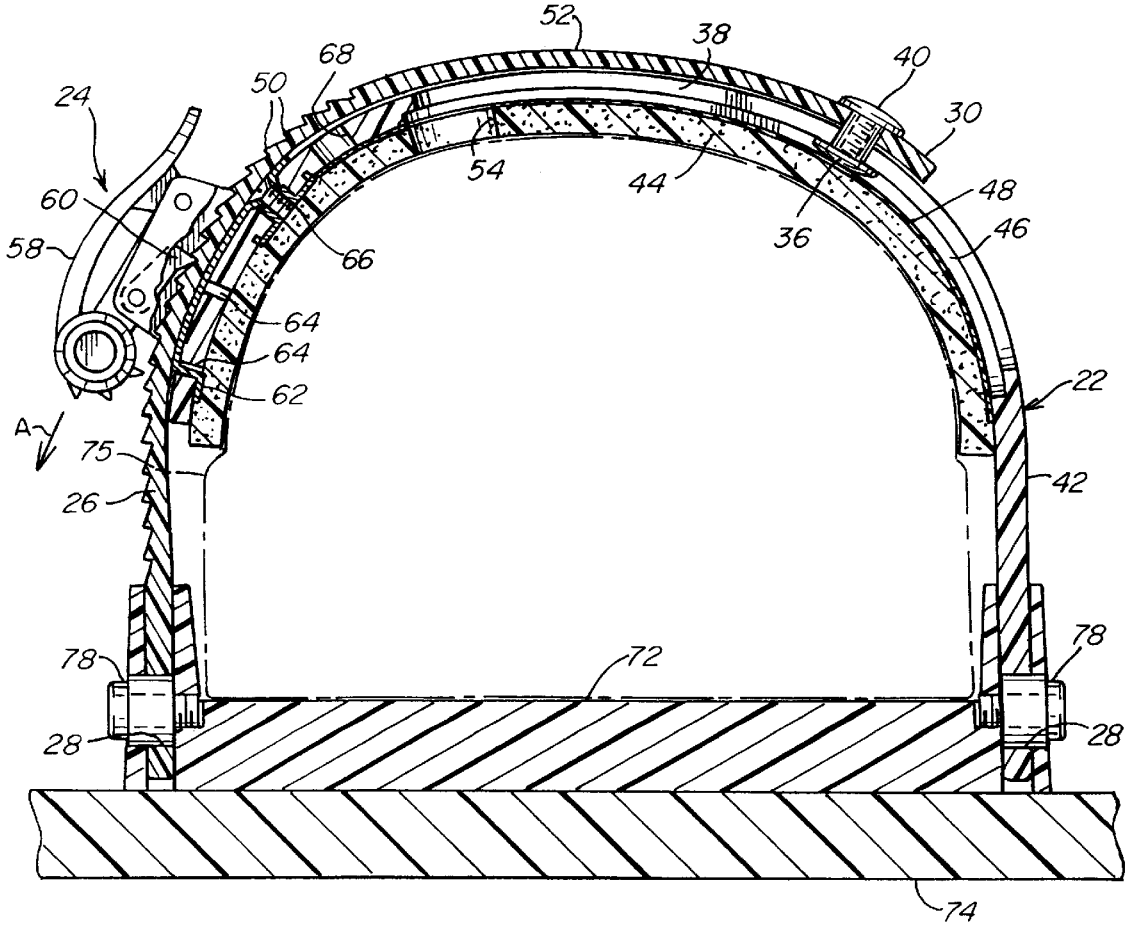
FIG. 5 is a front cross sectional view taken along section line 5—5 of FIG. 7 illustrating the strap of FIGS. 1–4 implemented on a binding and adjusted to a position between the fully shortened position of FIG. 1 and the fully extended position of FIG. 2.
Figure 6:
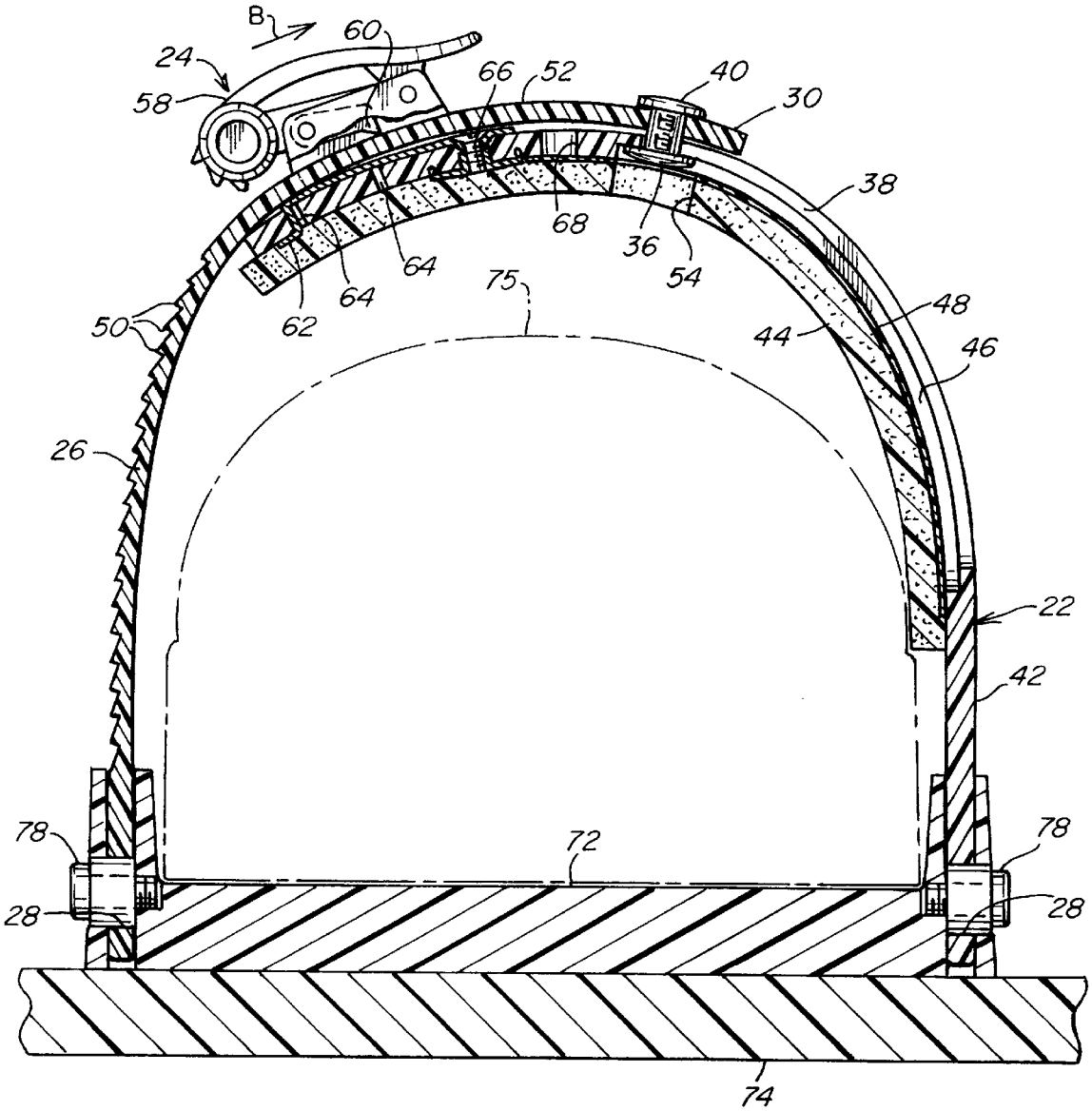
FIG. 6 is a front cross sectional view similar to FIG. 5 with the strap adjusted to the fully extended position of FIG. 2.

As described above, the ratchet and engagement straps are adjustably attached to each other by the ratchet buckle 24 and the anchor 36. As shown in FIGS. 5–6, the end portion of the ratchet strap 26 overlapping the engagement strap 22 from the ratchet buckle 24 to the anchor 36 is maintained in close proximity and generally parallel to the engagement strap 22 as the straps are adjusted relative to each other, even when adjusting the strap 20 across a curved surface, such as a boot. Attaching the ratchet strap 26 to the anchor 36 proximate its tip 30 substantially reduces the likelihood of a loose strap end that could potentially become entangled in clothing, boot laces or the like, such as when the strap is used in conjunction with a binding or a boot as described below. The tip portion 30 of the ratchet strap is maintained in close proximity to the engagement strap 22 at any selected amount of strap adjustment along the track.

Figure 4:
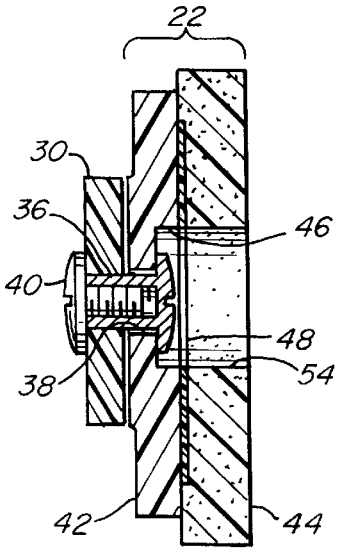
FIG. 4 is a cross sectional view taken along section line 4—4 of FIG. 2.

For some applications of the adjustable strap 20, it may be desirable to separate the ratchet strap 26 from the engagement strap 22. In one illustrative embodiment as shown in FIGS. 4–6, an access hole 54 is provided through the pad and the intermediate layer at one end of the slot to facilitate strap separation, as well as strap assembly. The anchor 36 may be inserted into and/or removed from the slot through the hole 54 so that the ratchet strap 26 may be fastened to or unfastened from the engagement strap 22. When disconnected, the ratchet strap may be withdrawn through the buckle and separated from the engagement strap.

In one embodiment shown in FIG. 2, the ratchet strap 26 may be provided with a cut line or relief 56 (shown in phantom) on the portion of extension 52 adjacent the teeth 50 so that the extension may be removed from the ratchet strap to decrease its length. The relief 56 may be particularly advantageous when a user prefers to permanently detach the ratchet strap from the anchor and use the adjustable strap in a conventional manner in which the strap portions can be completely separated from each other.

In one illustrative embodiment as shown in FIGS. 5–6, the ratchet buckle 24 includes an actuator 58 that may be operated to drive the ratchet strap 26 through the buckle to selectively tighten the strap. The buckle 24 also includes a pawl 60 that engages and retains the ratchet strap 26 so that the strap cannot be released until the pawl is disengaged from the ratchet strap. An example of a ratchet buckle that is particularly suited for implementation with the adjustable strap 20 of the present invention is described in U.S. Pat. No. 5,745,959, which is assigned to The Burton Corporation and incorporated herein by reference. This buckle may be conveniently operated using one hand to both tighten and loosen the strap portions relative to each other.

As best shown in FIGS. 5–6, the buckle 24 is mounted at the end of the engagement strap 22 using one or more fasteners, such as a screw/nut arrangement, a rivet or the like. As illustrated, the front end of the buckle housing includes a hook 62 that is inserted into a slot 64 in the strap body to retain the front end of the buckle and the rear end of the housing is secured to the strap body with a screw/lock nut arrangement 66 that is inserted through a hole 68 in the strap body. The strap body 42 may include multiple slots 64 and holes 68 to provide several mounting locations for the buckle so that the overall range of adjustment of the 30 adjustable strap may be varied to accommodate particular applications. For example, it may be desirable to position the buckle closer to or further away from the track to accommodate a particular boot size when the strap is used to secure the boot in a binding. When the buckle is located toward the track and away from the tip of the engagement strap, the excess portion at the end of the engagement strap extending beyond the buckle may be removed to shorten the strap.

In one embodiment, the ratchet strap 26 and the engagement strap body 42 are injection molded from a plastic material, such as polyurethane. The pad 44 is molded from a foam material, such as ethyl vinyl acetate (EVA), and the intermediate layer 48 is formed from a plastic material, such as polyethylene. It is to be appreciated, however, that the strap components may be formed with any suitable materials using any suitable manufacturing techniques.

The adjustable strap 20 of the present invention may be used to mount a member, such as sports shoes or boots, to an article such as a sports apparatus including, in-line skates, ski boots, snowboard boots and the like, and bindings for sports shoes or boots, such as snowboard bindings. For ease of understanding, however, and without limiting the scope of the invention, the inventive strap is now described below in connection with a snowboard binding.

Figure 7:
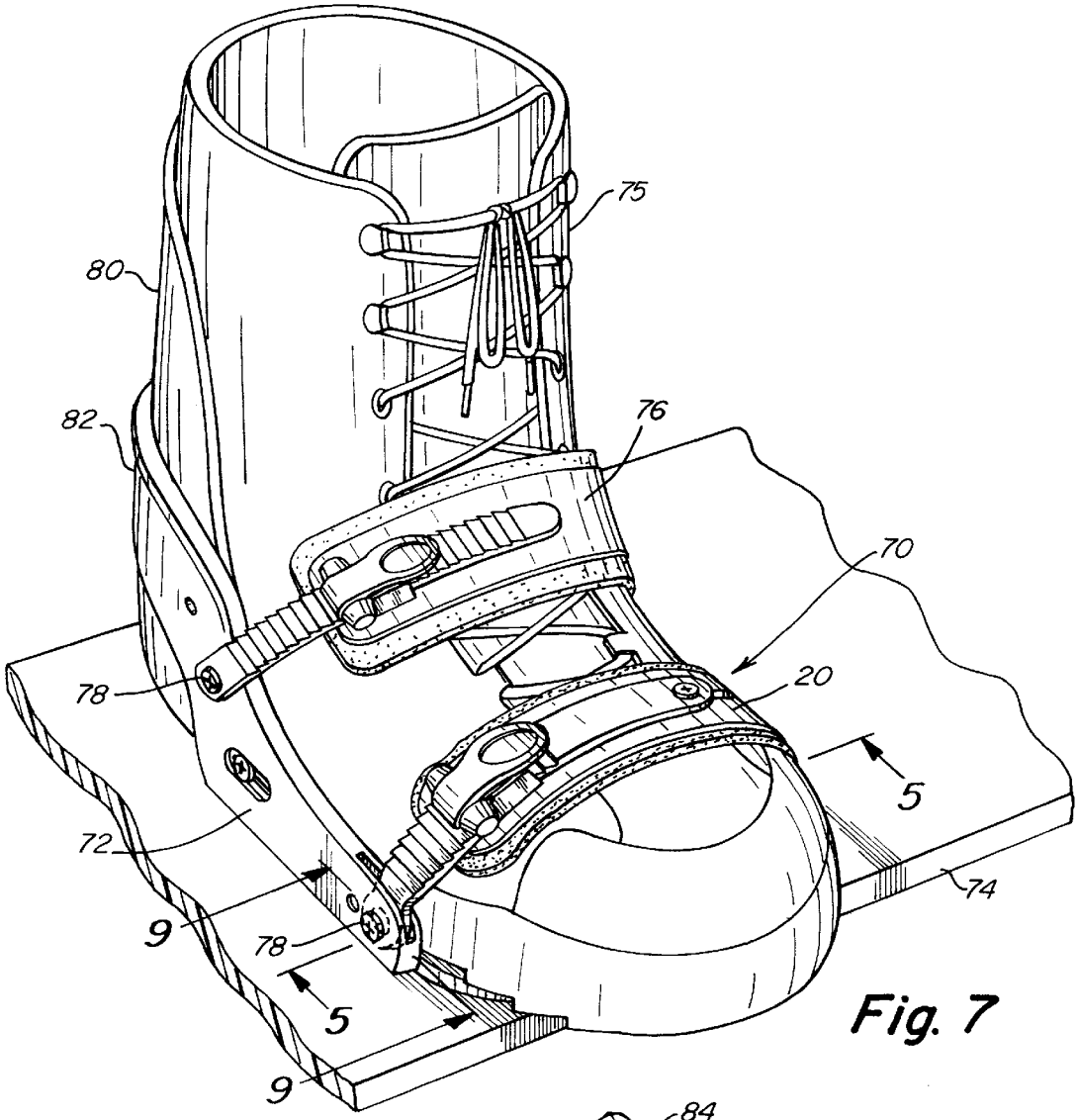
FIG. 7 is a perspective view of the adjustable strap of FIGS. 1–4 implemented as a toe strap on a snowboard binding for securing a boot to a snowboard.
Figure 8:
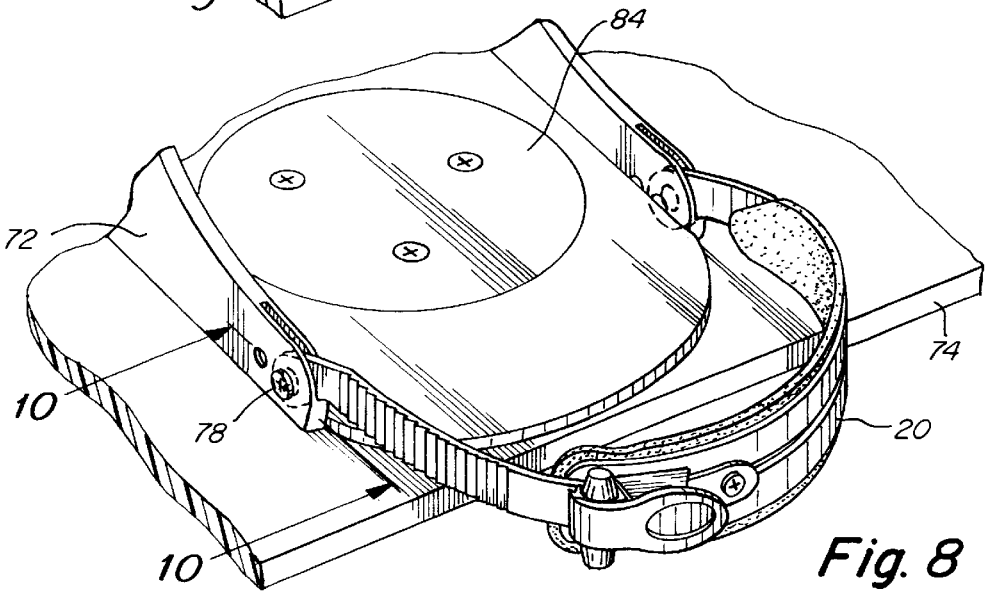
FIG. 8 is a fragmentary perspective view of the binding of FIG. 7 illustrating the toe strap pivoted to a forward position to allow boot removal from or placement in the binding.

In an illustrative embodiment shown in FIGS. 7–8, the snowboard binding 70 includes a base plate 72 that is mountable to a snowboard 74 and one or more binding straps, preferably adjustable straps, that extend across portions of the base plate for securing a boot 75 to the snowboard. As illustrated, the binding 70 may include an ankle strap 76 that extends across the ankle portion of the boot 75 to hold down the rider's heel and a toe strap 20 that extends across the binding and holds down the front portion of the boot. Each strap is attached to opposing sidewalls of the base plate by a bushing and/or fastener 78. It is to be understood that the binding may include a single binding strap, such as the ankle strap, or additional straps, such as a shin strap (not shown), and that the straps may be attached to other regions of the base plate.

The snowboard binding may include a high back 80 that is pivotally mounted to the baseplate to coact with a heel hoop 82 for providing heelside support and heel edge control. A forward lean adjuster (not shown) may also be provided to set the highback 80 at a preselected forward lean angle relative to the board and to lock down the highback for enhanced toe-side response. As shown in FIG. 8, a hold-down disc 84 may be used to secure the baseplate 72 to the snowboard 74 in any one of numerous stance angles. An example of a snowboard binding baseplate and hold-down disc is described in U.S. Pat. Nos. 5,261,689 and 5,356,170, which are assigned to The Burton Corporation and are incorporated herein by reference.

In one illustrative embodiment, the adjustable strap 20 of the present invention is implemented as a toe strap in combination with a conventional ankle strap 76 in which the strap portions can be completely separated from each other. It is to be appreciated, however, that the adjustable strap of the present invention may also be implemented as an ankle strap, either alone or in combination with a toe strap.

As illustrated in FIGS. 5 and 7, the front portion of the boot 75 is held down in the binding 70 by securely tightening the toe strap 20 across the upper surface of the boot. The strap may be coarsely adjusted over the boot 75 either by pushing the engagement and ratchet straps toward each other or by grasping and pulling the buckle 24 across the ratchet strap 26 (toward the left in FIG. 5 as indicated by arrow A) to draw the engagement strap 22 across the boot. Since the engagement and ratchet straps 22, 26 do not become separated when the adjustable strap is loosened, a user does not have to initially insert the ratchet strap through the buckle. This arrangement provides for quick and easy entry into the binding, particularly when fastening the binding in deep snow since the user does not have to visually align and mate the strap portions to each other.

As illustrated in FIGS. 6 and 8, the toe strap 20 may be loosened by releasing and pulling the buckle 24 toward the tip portion 30 of the ratchet strap 26 (toward the right in FIG. as indicated by arrow B). Once loosened, the toe strap 20 may be rotated down toward the front of the baseplate 72 (FIG. 8) so that the boot 75 may be easily removed from the binding. The forward strap position also allows easy entry into the binding since there are no loose strap portions that may flop onto the baseplate and be stepped on as the boot is placed on the baseplate. The adjustable strap 20 also eliminates loose strap portions that could potentially become caught in the ankle strap 76 when tightening the ankle strap.

Figure 9:
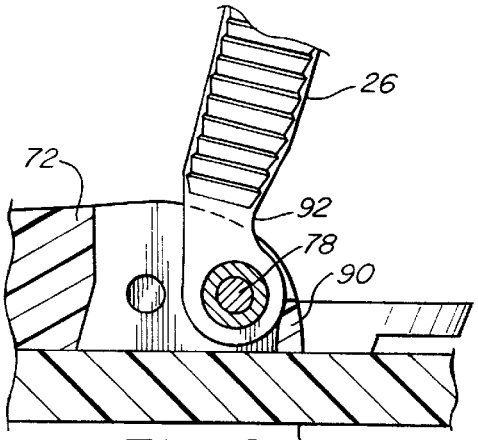
FIG. 9 is a cross—sectional side view taken along section line 9—9 of FIG. 7.
Figure 10:
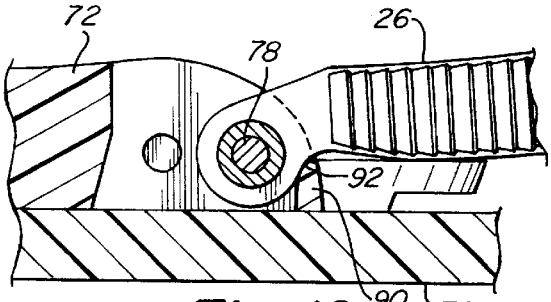
FIG. 10 is a cross—sectional side view taken along section line 10—10 of FIG. 8.

The adjustable strap 20 and/or the baseplate 72 may be configured to hold the strap above the horizontal plane of the baseplate when rotated to the forward position as shown in FIG. 8 to maintain the toe strap 20 above the ground. In one illustrative embodiment shown in FIGS. 9–10, the engagement and ratchet straps (only the ratchet strap 26 is shown) engage a corresponding abutment 90 provided on the baseplate 72. Each strap may have a contoured forward edge 92 that conforms closely to the shape of the abutment 90. In one embodiment, the abutment 90 and straps 22, 26 are configured to hold the toe strap approximately 10° above the horizontal plane of the baseplate. It is to be appreciated that the straps and/or the baseplate may be configured in any manner to hold the toe strap 20 at any desired position relative to the baseplate when rotated to the forward position.

The adjustable strap 20 of the present invention may also be used as a handle when implemented on a snowboard binding. For example, when ascending the mountain on a chair lift, a rider may hook her rear boot, which has been removed from the binding, into the strap during the ride in the chair lift. This allows the rider to balance the weight of the snowboard between both feet and to better control the board from twisting during the ride on a lift. The straps may also be used as handles to carry the board.

Figure 11:
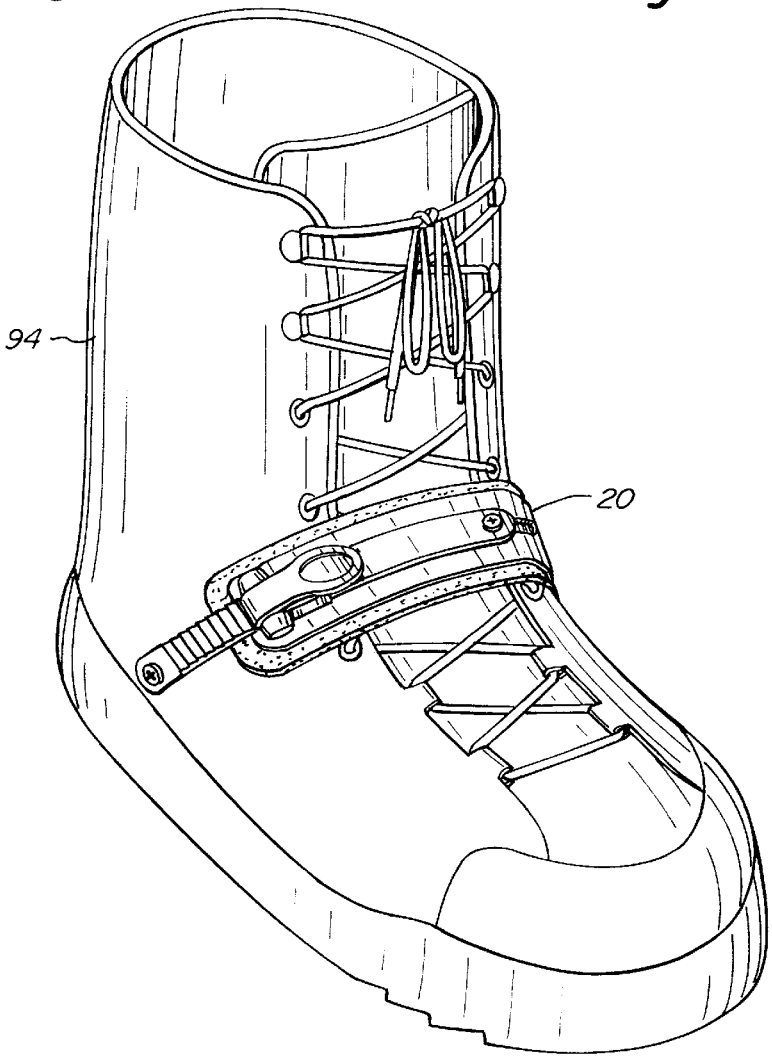
FIG. 11 is a perspective view of the adjustable strap of FIGS. 1–4 implemented as an ankle strap on a snowboard boot.

In another embodiment, the adjustable strap of the present invention may be mounted to a boot shell for snowboard boots, ski boots, in-line skates, and the like. As illustrated in FIG. 11, the adjustable strap 20 is mounted to a boot shell 94 as an ankle strap for extending across a portion of the boot to hold down a wearer's heel.

From the foregoing description, it will be appreciated that the adjustable strap of the present invention provides a convenient and easily operated strap that limits separation of the strap portions from each other for one hand operation. The adjustable strap may be particularly suitable for a soft boot snowboard binding which requires a user to release and secure the binding numerous times during a typical day of snowboarding. When the user wishes to secure a boot to a binding, the user steps into the binding, positions the strap across the boot and tightens the strap without having to initially align and mate the strap portions to each other. When the user wishes to loosen the strap so that he or she can step out of the binding, the user simply releases and pulls the buckle along the ratchet strap without separating the strap portions. The tightening and release operations can be easily accomplished by a user wearing gloves and other hand coverings.

Although the adjustable strap has been described in connection with a snowboard binding and snowboard boot, it is to be appreciated that the adjustable strap of the present invention may also be used on other articles which would benefit from quick and easy one hand operation in which a user may fully loosen and tighten the strap without the need for rejoining the strap portions to each other. For example, the strap may be used with various footwear, such as snowboard boots, ski boots, in-line skates and the like. The adjustable strap may also be used for binding or lashing down loads, such as securing a load to a vehicle roof and the like.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. An adjustable strap comprising:

a first strap including a fastening device mounted at one end thereof, the fastening device having a locking mode and a release mode;

a second strap extending through the fastening device to adjustably attach the second strap to the first strap; and a stop constructed and arranged to limit withdrawal of the second strap through the fastening device when the fastening device is in the release mode to otherwise permit withdrawal of the second strap therethrough, at least a portion of the stop being disposed on the first strap.

2. The adjustable strap according to claim 1, wherein the second strap is slidably received through the fastening device.

3. The adjustable strap according to claim 2, wherein the fastening device includes a ratchet buckle.

4. The adjustable strap according to claim 3, wherein the second strap includes a plurality of teeth along a portion thereof that are constructed and arranged to coact with the ratchet buckle to drive the second strap through the ratchet buckle to adjust the first and second straps relative to each other.

5. The adjustable strap according to claim 4, wherein the second strap includes an extension that is free of teeth, the extension being slidable through the ratchet buckle without actuation of the ratchet buckle.

6. An adjustable strap comprising:

a first strap including a fastening device mounted at one end thereof, the fastening device including a ratchet buckle having a locking mode and a release mode;

a second strap extending through the fastening device to adjustable attach the second strap to the first strap, the second strap includes a plurality of teeth along a portion thereof that are constructed and arranged to coact with the ratchet buckle to drive the second strap through the ratchet buckle to adjust the first and second straps relative to each other, the second strap further including a tip portion and an extension that is free of teeth, the extension being disposed between the plurality of teeth and the tip portion, the extension being slidable through the ratchet buckle without actuation of the ratchet buckle; and a stop constructed and arranged to limit withdrawal of the second strap through the fastening device when the fastening device is in the release mode to otherwise permit withdrawal of the second strap therethrough.

7. An adjustable strap comprising:

a first strap including a fastening device mounted at one end thereof, the fastening device including a ratchet buckle having a locking mode and a release mode;

a second strap extending through the fastening device to adjustably attach the second strap to the first strap, the second strap includes a plurality of teeth along a portion thereof that are constructed and arranged to coact with the ratchet buckle to drive the second strap through the ratchet buckle to adjust the first and second straps relative to each other, the second strap further including an extension that is free of teeth, the extension having a length that is greater than the length of the ratchet buckle, the extension being slidable through the ratchet buckle without actuation of the ratchet buckle; and a stop constructed and arranged to limit withdrawal of the second strap through the fastening device when the fastening device is in the release mode to otherwise permit withdrawal of the second strap therethrough.

8. The adjustable strap according to claim 1, wherein the stop includes an elongated track extending along a portion of the first strap and an anchor movably supported along the track, a portion of the second strap being secured to the anchor.

9. The adjustable strap according to claim 8, wherein the track has an elongated slot extending through the first strap, the anchor being slidably supported within the slot.

10. The adjustable strap according to claim 9, wherein the first strap includes a strap body and a pad supported on the strap body, the slot being disposed on the strap body.

11. The adjustable strap according to claim 10, wherein the strap body includes an elongated channel disposed on an inner surface thereof adjacent the pad, the channel being adapted to receive the anchor therein in spaced relation to the pad.

12. The adjustable strap according to claim 11, wherein the first strap further includes an intermediate layer disposed between the strap body and the pad to overlie the channel and separate the anchor from the pad.

13. The adjustable strap according to claim 1, in combination with a snowboarding article, the adjustable strap being supported by the snowboarding article.

14. The combination according to claim 13, wherein the snowboarding article includes a snowboard binding with a baseplate that is mountable to a snowboard, the adjustable strap being mounted to the baseplate to extend across a portion thereof to secure a boot to the snowboard.

15. The combination according to claim 14, wherein the adjustable strap is a toe strap that is extendable across a front portion of the boot.

16. The combination according to claim 13, wherein the snowboarding article includes a snowboard boot having a boot shell, the adjustable strap being mounted to the boot shell to extend across a portion of the snowboard boot.

17. An adjustable strap comprising:

a first strap including a buckle having a locking mode and a release mode; and a second strap being slidably received through the buckle to be adjustably secured at a first location by the buckle in the locking mode, the second strap being connected to the first strap at a second location that is spaced from the buckle so that the second strap remains connected to the first strap when the buckle is in the release mode, the second location varying relative to the buckle as the second strap is slidably adjusted relative to the first strap, a portion of the first and second straps overlapping each other between the first and second locations, the second strap being maintained substantially parallel to the first strap between the first and second locations as the second strap is slidably adjusted relative to the first strap.

18. The adjustable strap according to claim 17, wherein the first location is fixed relative to the first strap.

19. The adjustable strap according to claim 18, wherein the second location is fixed relative to the second strap.

20. The adjustable strap according to claim 17, further comprising an anchor slidably supported by the first strap at the second location, the second strap being secured to the anchor to maintain the second strap in close proximity to the first strap at the second location.

21. The adjustable strap according to claim 20, wherein the second strap includes a tip portion that is secured to the anchor.

22. The adjustable strap according to claim 17, wherein the buckle is a ratchet buckle.

23. The adjustable strap according to claim 22, wherein the second strap includes a plurality of teeth disposed along a portion thereof that are constructed and arranged to coact with the ratchet buckle to drive the second strap through the ratchet buckle to adjust the first and second straps relative to each other.

24. The adjustable strap according to claim 17, in combination with a snowboarding article, the adjustable strap being supported by the snowboarding article.

25. The combination according to claim 24, wherein the snowboarding article includes a snowboard binding with a baseplate that is mountable to a snowboard, the adjustable strap being mounted to the baseplate to extend across a portion thereof to secure a boot to the snowboard.

26. The combination according to claim 25, wherein the adjustable strap is a toe strap that is extendable across a front portion of the boot.

27. The combination according to claim 24, wherein the snowboarding article includes a snowboard boot having a boot shell, the adjustable strap being mounted to the boot shell to extend across a portion of the snowboard boot.

28. A snowboard binding comprising:

a baseplate that is mountable to a snowboard, the baseplate being adapted to receive a boot; and an adjustable strap mounted to the baseplate to extend across a portion thereof to secure the boot to the snowboard, the adjustable strap comprising:

a first strap including a fastening device mounted at a first end thereof, the fastening device having a locking mode and a release mode;

a second strap including an end portion extending through the fastening device to adjustably attach the second strap to the first strap; and an anchor slidably supported by the first strap, the end portion of the second strap being attached to the anchor to maintain the end portion in close proximity to the first strap and to limit withdrawal of the second strap through the fastening device when the fastening device is in the release mode to otherwise permit withdrawal of the second strap therethrough.

29. The snowboard binding according to claim 28, wherein the first strap has an elongated slot disposed along a portion thereof, the anchor being slidably supported within the slot.

30. The snowboard binding according to claim 29, wherein the first strap includes a strap body and a pad supported on the strap body, the slot extending through a portion of the strap body.

31. The snowboard binding according to claim 30, wherein the strap body includes an elongated channel disposed on an inner surface thereof adjacent the pad, the channel being adapted to receive the anchor therein in spaced relation to the pad.

32. The adjustable strap according to claim 31, wherein the first strap further includes an intermediate layer disposed between the strap body and the pad to overlie the channel and separate the anchor from the pad.

33. The snowboard binding according to claim 28. wherein the fastening device includes a ratchet buckle that incrementally drives the second strap therethrough.

34. The snowboard binding according to claim 33, wherein the second strap includes a plurality of teeth that coact with the ratchet buckle.

35. The adjustable strap according to claim 34, wherein the second strap includes an extension that is free of teeth, the extension being slidable through the ratchet buckle without actuation of the ratchet buckle.

36. The adjustable strap according to claim 35, wherein the second strap includes a tip portion and the extension is disposed between the plurality of teeth and the tip portion.

37. The adjustable strap according to claim 35, wherein the extension has a length that is greater than the length of the ratchet buckle.

38. An adjustable strap comprising:

a first strap including a buckle mounted at a first end thereof, the buckle including an engagement member having a locking mode and a release mode, the first strap having an elongated slot extending along a portion thereof;

a second strap being slidably received through the buckle to select a length of the adjustable strap, the engagement member to engage the second strap at at least one of a plurality of locations in the locking mode to prevent withdrawal of the second strap therethrough; and an anchor extending through the slot on the first strap, a portion of the second strap being attached to the anchor to limit withdrawal of the second strap through the buckle when the engagement member is in the release mode to otherwise permit withdrawal of the second strap therethrough.

39. The adjustable strap according to claim 38, wherein the second strap includes a tip portion that is secured to the anchor.

40. The adjustable strap according to claim 38, wherein the buckle is a ratchet buckle.

41. The adjustable strap according to claim 40, wherein the second strap includes a plurality of teeth disposed along a portion thereof that are constructed and arranged to coact with the ratchet buckle to drive the second strap through the ratchet buckle to adjust the first and second straps relative to each other.

42. The adjustable strap according to claim 38, in combination with a snowboarding article, the adjustable strap being supported by the snowboarding article.

43. The combination according to claim 42, wherein the snowboarding article includes a snowboard binding with a baseplate that is mountable to a snowboard, the adjustable strap being mounted to the baseplate to extend across a portion thereof to secure a boot to the snowboard.

44. The combination according to claim 43, wherein the adjustable strap is a toe strap that is extendable across a front portion of the boot.

45. The combination according to claim 42, wherein the snowboarding article includes a snowboard boot having a boot shell, the adjustable strap being mounted to the boot shell to extend across a portion of the snowboard boot.

* * * * *